US009430895B2

(12) United States Patent
Matsuura et al.

(10) Patent No.: US 9,430,895 B2
(45) Date of Patent: Aug. 30, 2016

(54) MONEY HANDLING APPARATUS

(71) Applicant: GLORY LTD., Himeji-Shi, Hyogo-ken (JP)

(72) Inventors: Shinji Matsuura, Tokyo (JP); Kozen Nakai, Funabashi (JP)

(73) Assignee: GLORY LTD., Himeji-shi, Hyogo-ken (JP)

( * ) Notice: Subject to any disclaimer, the term of this patent is extended or adjusted under 35 U.S.C. 154(b) by 0 days.

(21) Appl. No.: 14/617,362

(22) Filed: Feb. 9, 2015

(65) Prior Publication Data

US 2015/0154821 A1 Jun. 4, 2015

Related U.S. Application Data

(63) Continuation of application No. 13/982,828, filed as application No. PCT/JP2011/052008 on Feb. 1, 2011, now Pat. No. 8,978,865.

(51) Int. Cl.

| | |
|---|---|
| ***G07F 7/04*** | (2006.01) |
| ***G07D 11/00*** | (2006.01) |
| ***B07C 5/34*** | (2006.01) |

(52) U.S. Cl.

CPC ..... *G07D 11/0084* (2013.01); *B07C 5/34* (2013.01); *G07D 11/0018* (2013.01); *G07D 11/0021* (2013.01); *G07F 7/04* (2013.01)

(58) Field of Classification Search

CPC ..... G07F 7/04; G07F 19/00; G07D 7/00; G07D 11/00; G07D 11/0018; G07D 11/0021; G07D 11/0051; G07D 11/0084; G07D 2211/00; B07C 5/34

USPC ..... 194/206, 207; 209/534; 235/379

See application file for complete search history.

(56) References Cited

U.S. PATENT DOCUMENTS 6,493,461 B1 * 12/2002 Mennie ..... G07D 7/162 382/135

6,719,120 B2 4/2004 Kato (Continued)

FOREIGN PATENT DOCUMENTS

| | | |
|---|---|---|
| JP | 2000-259895 | 9/2000 |
| JP | 2005-165806 | 6/2005 |

(Continued)

OTHER PUBLICATIONS

European Search Report (Application No. 11857536.4—PCT/JP2011/052008) (10 pages—dated Apr. 6, 2014).

(Continued)

*Primary Examiner* — Mark Beauchaine

(74) *Attorney, Agent, or Firm* — Renner, Kenner, Greive, Bobak, Taylor & Weber

(57) ABSTRACT

A money handling apparatus includes an inlet to receive money of a plurality of different currencies, a plurality of outlets, and a control unit to control a transport unit, such that the money is sorted and delivered from the transport unit to respective outlets based on a money recognition result by a recognition unit. As such, the control unit determines whether the currencies that have been recognized by the recognition unit are assigned to any of the outlets. Thus, when the recognized currency is assigned to an outlet, the transport unit is controlled to transport the money of the associated currency to the assigned outlet. In addition, when the recognized currency is not assigned to an outlet, and if there is an outlet to which no currency is assigned, the control unit assigns the currency to such outlet and that the associated money is transported to the assigned outlet.

11 Claims, 11 Drawing Sheets

(56) References Cited

U.S. PATENT DOCUMENTS

| | | | | |
|---|---|---|---|---|
| 2002/0056958 | A1* | 5/2002 | Urata et al. | 271/10.01 |
| 2003/0015395 | A1* | 1/2003 | Hallowell et al. | 194/206 |
| 2004/0003980 | A1 | 1/2004 | Hallowell et al. | |
| 2004/0026497 | A1* | 2/2004 | Ho et al. | 235/379 |
| 2008/0054545 | A1 | 3/2008 | Calverley et al. | |

FOREIGN PATENT DOCUMENTS

| | | | |
|---|---|---|---|
| WO | WO 2008/129228 | A1 | 10/2008 |
| WO | WO 2009/122504 | A1 | 10/2009 |
| WO | WO 2010/032310 | A1 | 3/2010 |
| WO | WO 2010/032337 | A1 | 3/2010 |

OTHER PUBLICATIONS

Japanese Office Action with English Translation (Japanese Application No. 2012-555611) (6 pages—dated Jun. 17, 2014).

Chinese Office Action (Chinese Application No. 201180066603.6) (17 pages—dated Dec. 26, 2014).

English Translation of Chinese Office Action (Chinese Application No. 201180066603.6) (22 pages—Undated).

Japanese Office Action (Application No. 2014-199241) (6 pages—dated Sep. 1, 2015).

* cited by examiner

◎FIRST COUNTING PROCESS

| | FIRST STACKER | SECOND STACKER | THIRD STACKER | REJECT UNIT |
|---|---|---|---|---|
| SETTING OF STACKER | CURRENCY AUTO | CURRENCY AUTO | CURRENCY AUTO | – |
| BANKNOTES TO BE STACKED | US DOLLAR (DENOMINATION MIXED) | EURO (DENOMINATION MIXED) | TURKISH LIRA (DENOMINATION MIXED) | • REJECT BANKNOTE<br>• BANKNOTE OTHER THAN US DOLLAR BANKNOTE, EURO BANKNOTE, TURKISH LIRA BANKNOTE |

⇩

◎SECOND COUNTING PROCESS

| | FIRST STACKER | SECOND STACKER | THIRD STACKER | REJECT UNIT |
|---|---|---|---|---|
| SETTING OF STACKER | DENOMINATION AUTO | DENOMINATION AUTO | DENOMINATION AUTO | – |
| BANKNOTES TO BE STACKED | US DOLLAR BANKNOTE OF $100 | US DOLLAR BANKNOTE OF $20 | US DOLLAR BANKNOTE OF $10 | • REJECT BANKNOTE<br>• US DOLLAR BANKNOTE OF ANOTHER DENOMINATION<br>• BANKNOTE OTHER THAN US DOLLAR BANKNOTE |

| | FIRST STACKER | SECOND STACKER | THIRD STACKER | REJECT UNIT |
|---|---|---|---|---|
| SETTING OF STACKER | DENOMINATION AUTO | DENOMINATION AUTO | DENOMINATION AUTO | – |
| BANKNOTES TO BE STACKED | EURO BANKNOTE OF €100 | EURO BANKNOTE OF €20 | EURO BANKNOTE OF €10 | • REJECT BANKNOTE<br>• EURO BANKNOTE OF ANOTHER DENOMINATION<br>• BANKNOTE OTHER THAN EURO BANKNOTE |

| | FIRST STACKER | SECOND STACKER | THIRD STACKER | REJECT UNIT |
|---|---|---|---|---|
| SETTING OF STACKER | DENOMINATION AUTO | DENOMINATION AUTO | DENOMINATION AUTO | – |
| BANKNOTES TO BE STACKED | TURKISH LIRA BANKNOTE OF 100 LIRA | TURKISH LIRA BANKNOTE OF 20 LIRA | TURKISH LIRA BANKNOTE OF 10 LIRA | • REJECT BANKNOTE<br>• TURKISH LIRA BANKNOTE OF ANOTHER DENOMINATION<br>• BANKNOTE OTHER THAN TURKISH LIRA BANKNOTE |

FIG. 5

◎FIRST COUNTING PROCESS

| | FIRST STACKER | SECOND STACKER | THIRD STACKER | REJECT UNIT |
|---|---|---|---|---|
| SETTING OF STACKER | US DOLLAR·DENOMINATION AUTO | US DOLLAR·DENOMINATION AUTO | CURRENCY AUTO | — |
| BANKNOTES TO BE STACKED | US DOLLAR BANKNOTE OF $100 | US DOLLAR BANKNOTE OF $20 | EURO (DENOMINATION MIXED) | • REJECT BANKNOTE<br>• US DOLLAR BANKNOTE OTHER THAN $100 BANKNOTE AND $20 BANKNOTE<br>• BANKNOTE OTHER THAN US DOLLAR BANKNOTE AND EURO BANKNOTE |

FIG. 8

◎FIRST COUNTING PROCESS

| | FIRST STACKER | SECOND STACKER | THIRD STACKER | REJECT UNIT |
|---|---|---|---|---|
| SETTING OF STACKER | CURRENCY AUTO FIT BANKNOTE | CURRENCY AUTO UNFIT BANKNOTE | CURRENCY AUTO | – |
| BANKNOTES TO BE STACKED | US DOLLAR FIT BANKNOTE (DENOMINATION MIXED) | US DOLLAR UNFIT BANKNOTE (DENOMINATION MIXED) | EURO (DENOMINATION MIXED) | •REJECT BANKNOTE<br>•BANKNOTE OTHER THAN US DOLLAR BANKNOTE AND EURO BANKNOTE |

FIG. 10

◎FIRST COUNTING PROCESS

| | FIRST STACKER | SECOND STACKER | THIRD STACKER | REJECT UNIT |
|---|---|---|---|---|
| SETTING OF STACKER | CURRENCY AUTO DENOMINATION AUTO ATM FIT BANKNOTE | CURRENCY AUTO DENOMINATION AUTO FIT BANKNOTE | CURRENCY AUTO DENOMINATION AUTO UNFIT BANKNOTE | — |
| BANKNOTES TO BE STACKED | US DOLLAR·FIRST DENOMINATION ATM FIT BANKNOTE | US DOLLAR·FIRST DENOMINATION FIT BANKNOTE | US DOLLAR·FIRST DENOMINATION UNFIT BANKNOTE | •REJECT BANKNOTE<br>•US DOLLAR BANKNOTE OF SECOND, THIRD, ··· DENOMINATIONS<br>•BANKNOTE OTHER THAN US DOLLAR BANKNOTE |

FIG. 12

MONEY HANDLING APPARATUS

CROSS-REFERENCE TO RELATED APPLICATION

This application is a continuation of U.S. patent application Ser. No. 13/982,828 filed on Jul. 31, 2013, which is incorporated herein by reference, which was based upon and claimed the benefit of priority from the prior PCT/JP2011/052008 filed on Feb. 1, 2011, the entire contents of which are incorporated herein by reference.

TECHNICAL FIELD

The present invention relates to a money handling apparatus configured to handle money such as banknotes and coins. In particular, the present invention relates to a money handling apparatus capable of efficiently carrying out a money sorting operation, when money issued by various money issuing countries is placed in a mixed state in an inlet.

BACKGROUND ART

Various kinds of sorting apparatuses configured to sort money such as banknotes have been conventionally known. For example, JP2005-165806A discloses a sorting apparatus including one inlet and a plurality of (e.g., three) outlets, wherein banknotes, which have been taken into an apparatus body from the inlet, are transported, one by one, by a transport unit and recognized by a recognition unit, so that the banknotes are sorted by denomination and delivered to the respective outlets.

As a conventional sorting apparatus, there has been known a sorting apparatus which is of a type for assigning denominations of money to respective outlets. In such a sorting apparatus, it is judged whether a denomination of money having been recognized by a recognition unit is assigned to any of the outlets. When the denomination is assigned, the money is transported to the assigned outlet. On the other hand, when the denomination of the money having been recognized by the recognition unit is not assigned to any of the outlet, if there is an outlet to which no denomination is assigned, the denomination of the money having been recognized by the recognition unit is assigned to the outlet and the money is transported to the assigned outlet. Alternatively, when the outlet to which the denomination of the money having been recognized by the recognition unit is assigned is full, if there is another outlet to which no denomination is assigned, the denomination of the money having been recognized by the recognition unit is assigned to the latter outlet as well, and the money is transported to the assigned latter outlet. Alternatively, when the denomination of the money having been recognized by the recognition unit is not assigned to any of the outlets, if there is no outlet to which no denomination is assigned, the money is transported to a reject unit. When an outlet is filled with money, an operator takes the money out of the outlet, and assignment of denomination to the outlet is reset. According to such a sorting apparatus, in particular, when denominations of money are non-uniform, that is, when an amount of money of a specific denomination is sufficiently larger than an amount of money of another denomination, an operation for sorting the money by denomination can be performed promptly.

DISCLOSURE OF THE INVENTION

However, in the conventional sorting apparatus, when money issued by various money issuing countries and/or issuing organizations (e.g., EU) is placed in a mixed state in an inlet, in particular, when an amount of money of a specific issuing country or a specific issuing organization is larger than an amount of money of another currency, it takes a long time for the sorting apparatus to perform a sorting operation. Namely, when money issued by various money issuing countries and/or issuing organizations is simultaneously handled by one sorting apparatus, the conventional sorting apparatus is configured to assign the money issuing countries and so on to the respective outlets. However, even when a ratio of money issued by a specific issuing country or the like is large, it is impossible to increase or change an outlet to correspond to the money, which makes inefficient the money sorting operation.

The present invention has been made in view of the circumstances. The object of the present invention is to provide a money handling apparatus capable of efficiently carrying out a money sorting operation, when money issued by various money issuing countries and so on is placed in a mixed state in an inlet.

The present invention is a money handling apparatus including:

an inlet configured to receive money of a plurality of different currencies and to take the received money into an apparatus body;

a plurality of outlets;

a transport unit configured to transport, one by one, the money having been taken into the apparatus body from the inlet to the respective outlets;

a recognition unit disposed on the transport unit and configured to recognize the money of different currencies; and a control unit configured to control the transport unit such that the money is sorted and delivered from the transport unit to the respective outlets, based on the money recognition result by the recognition unit;

wherein:

the control unit is configured to judge whether the currency of each money having been recognized by the recognition unit is assigned to any of the outlets, and when the currency of the money having been recognized by the recognition unit is assigned to any of the outlets, the control unit is configured to perform such a control that the money is transported to the assigned outlet, and when the currency of the money having been recognized by the recognition unit is not assigned to any of the outlets, if there is an outlet to which no currency is assigned, the control unit is configured to perform such a control that the currency is assigned to the outlet and that the money is transported to the outlet.

In the money handling apparatus of the present invention, when the money having been sorted and delivered to the respective outlets are counted for the second time by the money handling apparatus, the control unit may be configured to perform such a control that the money is sorted for each currency and for each denomination and delivered to the respective outlets.

At this time, when a money count result by a second counting process matches to a money count result by a first counting process, the control unit may be configured to automatically confirm a deposit amount of money.

In addition, while a second counting process is performed by the money handling apparatus, the control unit may be configured not to cause the recognition unit to authenticate the money.

In addition, when a second counting process is performed by the money handling apparatus, the control unit may be configured to automatically assign, to the respective outlets, for each currency, denominations in descending order of the number of money of each denomination in a money count result by a first counting process by means of the recognition unit.

In the money handling apparatus of the present invention, when a confirmation command is given to the control unit after the first counting process has been ended by the money handling apparatus, the control unit may be configured to confirm a deposit amount of money for each currency.

In addition, when reject money is detected by the recognition unit, the control unit may be configured such that a currency of the reject money and a denomination thereof are capable of being manually inputted to the control unit.

At this time, the money handling apparatus may further includes a display unit, and when the currency of the reject money has been judged by the recognition unit upon detection of the reject money by the recognition unit, the control unit may be configured to suspend the money handling process performed by the money handling apparatus, and to cause the display unit to display reject money information.

In the money handling apparatus of the present invention, the control unit may be configured to assign a currency of money having been firstly recognized by the recognition unit to a plurality of outlets.

The present invention is a money handling apparatus including:

an inlet configured to receive money of a plurality of different currencies and to take the received money into an apparatus body;

a plurality of outlets;

a transport unit configured to transport, one by one, the money having been taken into the apparatus body from the inlet to the respective outlets;

a recognition unit disposed on the transport unit and configured to recognize the money of different currencies; and a control unit configured to control the transport unit such that the money is sorted and delivered from the transport unit to the respective outlets, based on the money recognition result by the recognition unit;

wherein:

the control unit is configured to assign beforehand a beforehand specified currency to a predetermined outlet, and when money of the beforehand specified currency is firstly recognized by the recognition unit, the control unit configured to assign a denomination of the money to the predetermined outlet; and the control unit is configured to judge whether both the currency of each money having been recognized by the recognition unit and the denomination thereof are assigned to any of the outlets, and when both the currency of the money and the denomination thereof are assigned to any of the outlets, the control unit is configured to perform such a control that the money is transported to the assigned outlet.

In the money handling apparatus of the present invention, the beforehand specified currency may be assigned beforehand to a plurality of predetermined outlets.

In addition, when the currency of the money having been recognized by the recognition unit is not the beforehand specified currency, if there is an outlet to which no currency is assigned, the control unit may be configured to perform such a control that the currency is assigned to the outlet and that the money is transported to the outlet, and, if there is an outlet to which the currency is assigned, the control unit may be configured to perform such a control that the money is transported to the outlet.

The present invention is a money handling apparatus including:

an inlet configured to receive money of a plurality of different currencies and to take the received money into an apparatus body;

a plurality of outlets;

a transport unit configured to transport, one by one, the money having been taken into the apparatus body from the inlet to the respective outlets;

a recognition unit disposed on the transport unit and configured to recognize the money of different currencies; and a control unit configured to control the transport unit such that the money is sorted and delivered from the transport unit to the respective outlets, based on the money recognition result by the recognition unit;

wherein:

the control unit is configured to assign beforehand a beforehand specified category to a predetermined outlet, and when money of the beforehand specified category is firstly recognized by the recognition unit, the control unit is configured to assign a currency of the money to the predetermined outlet; and the control unit is configured to judge whether both the currency of each money having been recognized by the recognition unit and the category thereof are assigned to any of the outlets, and when both the currency of the money and the category thereof are assigned to any of the outlets, the control unit is configured to perform such a control that the money is transported to the assigned outlet.

In the money handling apparatus of the present invention, after the currency has been assigned to the predetermined outlet, when money of another currency is recognized by the recognition unit, the control unit may be configured to assign the other currency to an outlet other than the predetermined outlet.

In addition, the category may have three or more levels of fitness relating to fit note/unfit note.

In addition, the control unit may be configured to assign a currency of the money having been firstly recognized by the recognition unit to three or more outlets, and the beforehand specified category is assigned to two of these outlets.

The aforementioned money handling apparatus may further include a display unit, and the control unit may be configured to cause the display unit to selectively display, in an alternate manner for each currency, a total amount of money for each currency and/or the number or amount of money for each denomination.

In this case, when the total amount of money for each currency is displayed on the display unit, the control unit may be configured to cause the display unit to display the total amount of money for each currency in a manner converted to a predetermined currency.

In addition, the aforementioned money handling apparatus may further include a display unit, and the control unit may be configured to cause the display unit to display currencies assigned to the respective outlets.

In addition, the currency may be determined by an issuing organization including a nation that issues money.

Alternatively, the currency may be determined by an issuing organization including a nation that issues money, and may include a currency substitution medium.

BRIEF DESCRIPTION OF THE DRAWINGS

FIG. 5 is an explanatory view showing setting contents of respective stackers and types of banknotes to be stacked in the respective stackers and a reject unit, in a first operation aspect of the banknote handling apparatus;

FIG. 8 is an explanatory view showing setting contents of respective stackers and types of banknotes to be staked in the respective stackers and the reject unit, in a second operation aspect of the banknote handling apparatus;

FIG. 10 is an explanatory view showing setting contents of respective stackers and types of banknotes to be stacked in the respective stackers and the reject unit, in a third operation aspect of the banknote handling apparatus;

FIG. 12 is an explanatory view showing setting contents of respective stackers and types of banknotes to be stacked in the respective stackers and the reject unit, in a fourth operation aspect of the banknote handling apparatus.

BEST MODE FOR CARRYING OUT THE INVENTION

An embodiment of the present invention will be described herebelow with reference to the drawings. In this embodiment, explanation is made about a case in which a banknote handling apparatus configured to handle banknotes is used as a money handling apparatus of the present invention.

An overall structure of the banknote handling apparatus in this embodiment is firstly described with reference to FIGS. 1 to 3.

Figure 1:
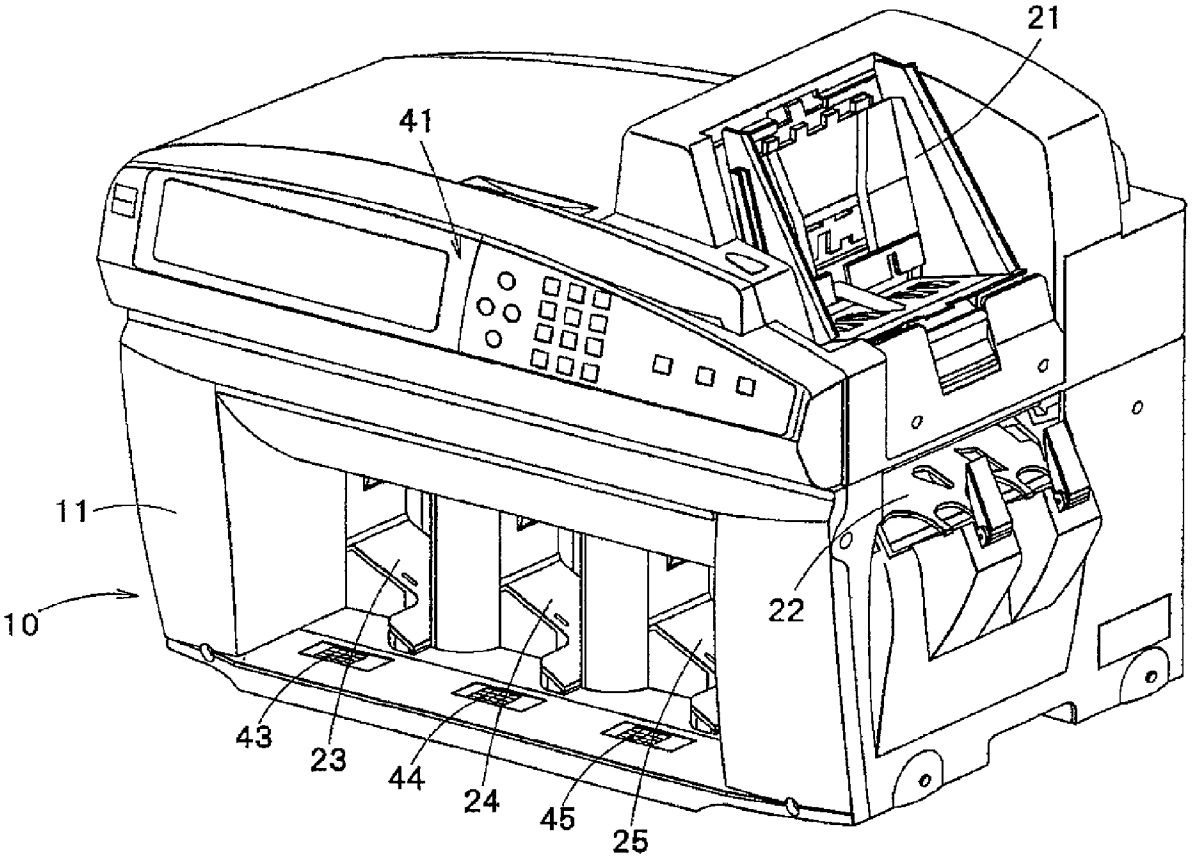
FIG. 1 is a perspective view showing an appearance of a banknote handling apparatus in an embodiment of the present invention.

FIG. 1 is a perspective view showing an appearance of the banknote handling apparatus 10 in this embodiment. FIG. 2 is a schematic structural view schematically showing an inside structure of the banknote handling apparatus 10 shown in FIG. 1. As shown in FIG. 1, the banknote handling apparatus 10 includes a housing 11 of a substantially parallelepiped shape, an inlet 21 configured to receive a plurality of banknotes and to take the received banknotes into the housing 11, a first stacker (first outlet) 23, a second stacker (second outlet) 24, a third stacker (third outlet) 25 and a reject unit 22.

To be specific, a plurality of banknotes in a stacked state are placed by an operator in the inlet 21. As shown in FIG. 2, the inlet 21 is provided with a feeding mechanism 21*a*. Banknotes placed in the inlet 21 are taken, one by one, into the housing 11 by the feeding mechanism 21*a*.

Figure 2:
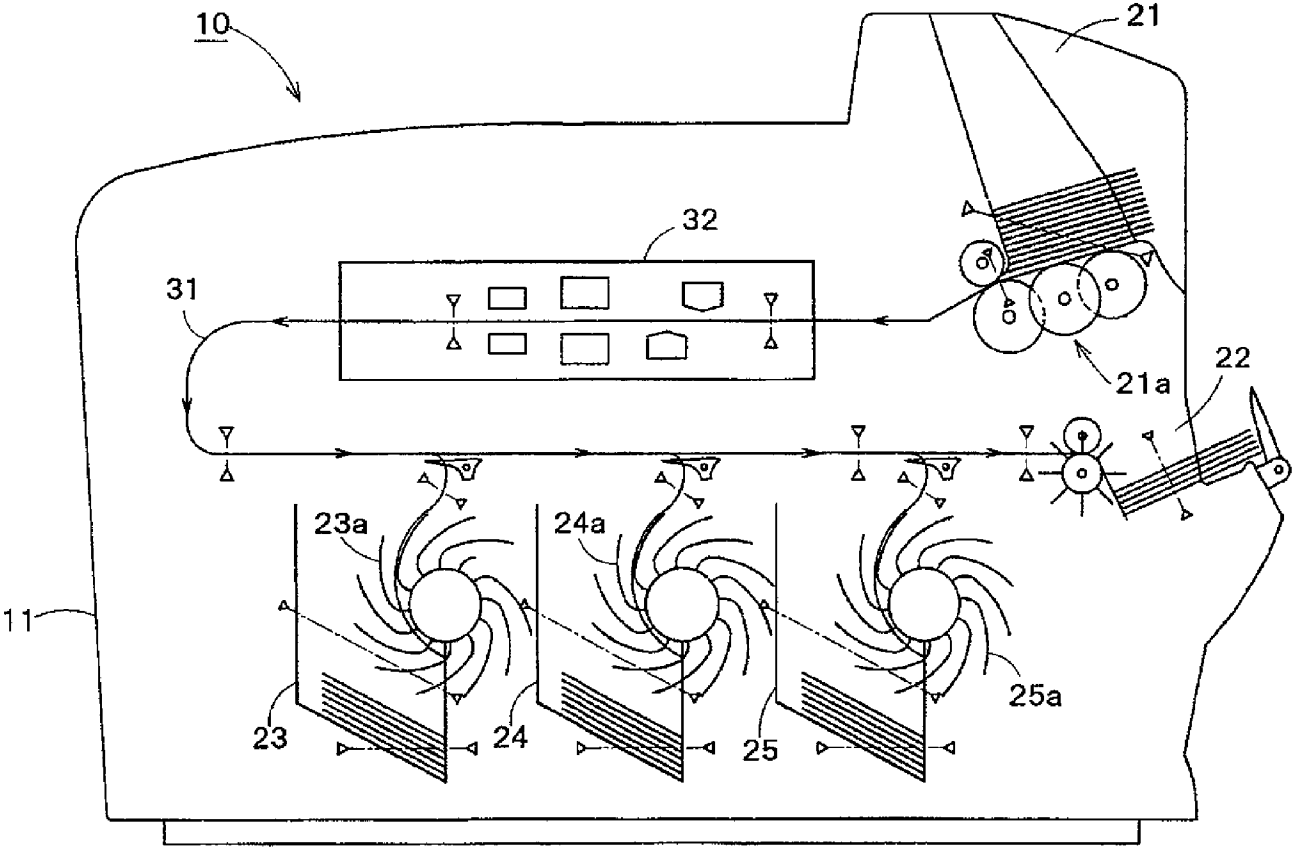
FIG. 2 is a schematic structural view schematically showing an inside structure of the banknote handling apparatus shown in FIG. 1.

In addition, as shown in FIG. 2, a transport unit 31 is disposed in the housing 11 of the banknote handling apparatus 10. The banknotes, which have been taken into the housing 11 by the feeding mechanism 21*a*, are sequentially transported, one by one, by the transport unit 31 in the housing 11.

As shown in FIG. 2, the transport unit 31 has a recognition unit 32. The recognition unit 32 is configured to recognize a denomination, an authenticity, a fitness and so on of each banknote transported by the transport unit 31. A banknote recognition result by the recognition unit 32 is transmitted to a control unit 40 which is described below.

As shown in FIG. 2, the first stacker 23, the second stacker 24 and the third stacker 25 are respectively connected to the transport unit 31. Based on a banknote recognition result by the recognition unit 32, each banknote is transported from the transport unit 31 to any one of the three stackers 23, 24 and 25. Banknotes are stacked in a stacked state in the respective stackers 23, 24 and 25. As shown in FIG. 1, an operator can access the respective stackers 23, 24 and 25 from outside the housing 11. Thus, when banknotes have been stacked in the respective stackers 23, 24 and 25, an operator can take out a batch of the banknotes from these stackers 23, 24 and 25. In addition, as shown in FIG. 2, the stackers 23, 24 and 25 are respectively provided with stacking wheels 23*a*, 24*a* and 25*a*. Each of the stacking wheels 23*a*, 24*a* and 25*a* has a function of receiving a banknote, which is discharged from the transport unit 31 toward each of the stackers 23, 24 and 25, in a space between adjacent vanes, and of allowing the banknote to be laid in each of the stackers 23, 24 and 25 under a condition wherein an orientation and a position of the banknote are adjusted.

The reject unit 22 is also connected to the transport unit 31. Based on a banknote recognition result by the recognition unit 32, for example, a banknote that was recognized as a reject banknote by the recognition unit 32, a banknote that could not be recognized by the recognition unit 32, and a banknote that was detected as an erroneously transported banknote by the recognition unit 32, are transported from the transport unit 31 to the reject unit 22.

In addition, as shown in FIG. 1, an operation display unit 41 is disposed on a front surface of the housing 11 of the banknote handling apparatus 10. The operation display unit 41 has a plurality of operation keys. When an operator pushes down these operation keys, various commands are transmitted to the below-described control unit 40. The operation display unit 41 is provided with a monitor, so that a banknote handling condition in the banknote handling apparatus 10, specifically, the number of banknotes stacked in each of the stackers 23, 24 and 25 and an amount thereof, for example, can be displayed. Details of the display contents of the monitor of the operation display unit 41 are described hereafter.

In addition, as shown in FIG. 1, three display units 43, 44 and 45 corresponding to the respective stackers 23, 24 and 25 are disposed on the front surface of the housing 11 of the banknote handling apparatus 10. Details of display contents of the display units 43, 44 and 45 are described hereafter.

Figure 3:
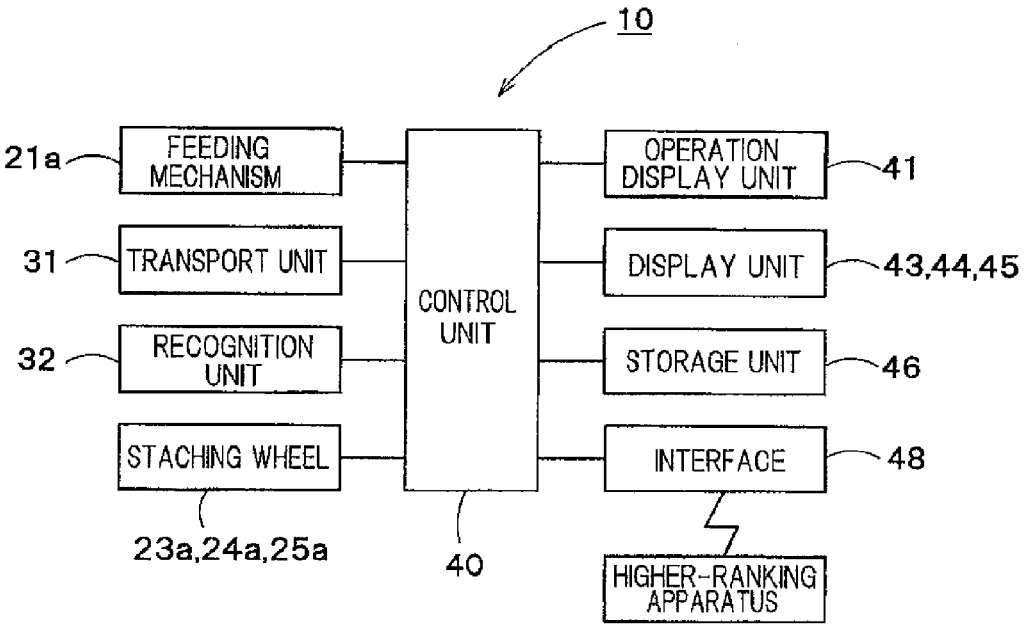
FIG. 3 is a functional block view of the banknote handling apparatus shown in FIGS. 1 and 2.

In addition, as shown in FIG. 3, the banknote handling apparatus 10 is provided with the control unit 40. The control unit 40 is configured to control respective constituent elements of the banknote handling apparatus 10. To be specific, the feeding mechanism 21*a*, the transport unit 31, the recognition unit 32 and the stacking wheels 23*a*, 24*a* and 25*a* are respectively connected to the control unit 40. Thus, a banknote recognition result by the recognition unit 32 is transmitted to the control unit 40, and control signals are transmitted from the control unit 40 to the feeding mechanism 21*a*, the transport unit 31 and the stacking wheels 23*a*, 24 and 25*a*, whereby these constituent elements are controlled by the control unit 40. In addition, as shown in FIG. 3, the operation display unit 41 and the respective display units 43, 44 and 45 are also respectively connected to the control unit 40. Thus, the display contents of the operation display unit 41 and the respective display units 43, 44 and 45 are controlled by the control unit 40. In addition, as described above, an operator can transmit various commands to the control unit 40 through the operation display unit 41.

In addition, as shown in FIG. 3, the banknote handling apparatus 10 is provided with a memory unit 46. The memory unit 46 is connected to the control unit 40. In addition, the banknote handling apparatus 10 is provided with an interface 48. The interface 48 is connected to the control unit 40. The control unit 40 can transmit and receive a signal through the interface 48 to and from a higher-ranking apparatus or the like disposed outside the banknote handling apparatus 10.

Next, an operation of the banknote handling apparatus 10 as structured above is described. More specifically, there is described an operation of the banknote handling apparatus 10 when a plurality of banknotes of different currencies are handled by the banknote handling apparatus 10. A currency is defined by an issuing organization including a banknote issuing country. Specifically, currencies are, for example, Japanese yen, US dollar, Euro, Turkish lira and so on. The following operation of the banknote handling apparatus 10 is performed by the control unit 40 that controls the respective constituent elements of the banknote handling apparatus 10.

In a first operation aspect of the banknote handling apparatus 10, no currency is assigned to the stackers 23, 24 and 25 in a default state. In other words, settings of the respective stackers 23, 24 and 25 are "Currency AUTO" (see "First counting process" of FIG. 5).

Figure 4:
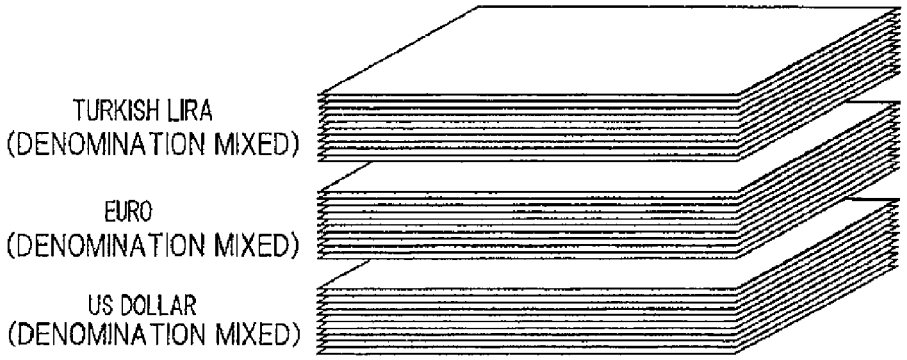
FIG. 4 is a perspective view showing a state in which a plurality of batches of banknotes of respective currencies are stacked one on another.

At first, as shown in FIG. 4, a plurality of batches of banknotes of respective currencies are stacked one on another. Specifically, a plurality of batches of banknotes are formed by stacking, on a batch of banknotes of a certain currency, a batch of banknotes of another currency. To be more specific, a batch of Euro banknotes are stacked on a batch of US dollar banknotes, and a batch of Turkish lira banknotes are further stacked on the batch of Euro banknotes. At this time, banknotes of different denominations are mixed (denomination mixed state) in each of the batch of US dollar banknotes, the batch of Euro banknotes and the batch of Turkish lira banknotes.

Then, the plurality of batches of banknotes as shown in FIG. 4 are subjected to a first counting process. To be specific, the plurality of batches of banknotes as shown in FIG. 4 are simultaneously placed in the inlet 21 of the banknote handling apparatus 10. The banknotes placed in the inlet 21 are taken, one by one, into the housing 11 by the feeding mechanism 21*a*. The banknote having been taken into the housing 11 is recognized by the recognition unit 32 (STEP 1 of FIG. 6).

Figure 6:
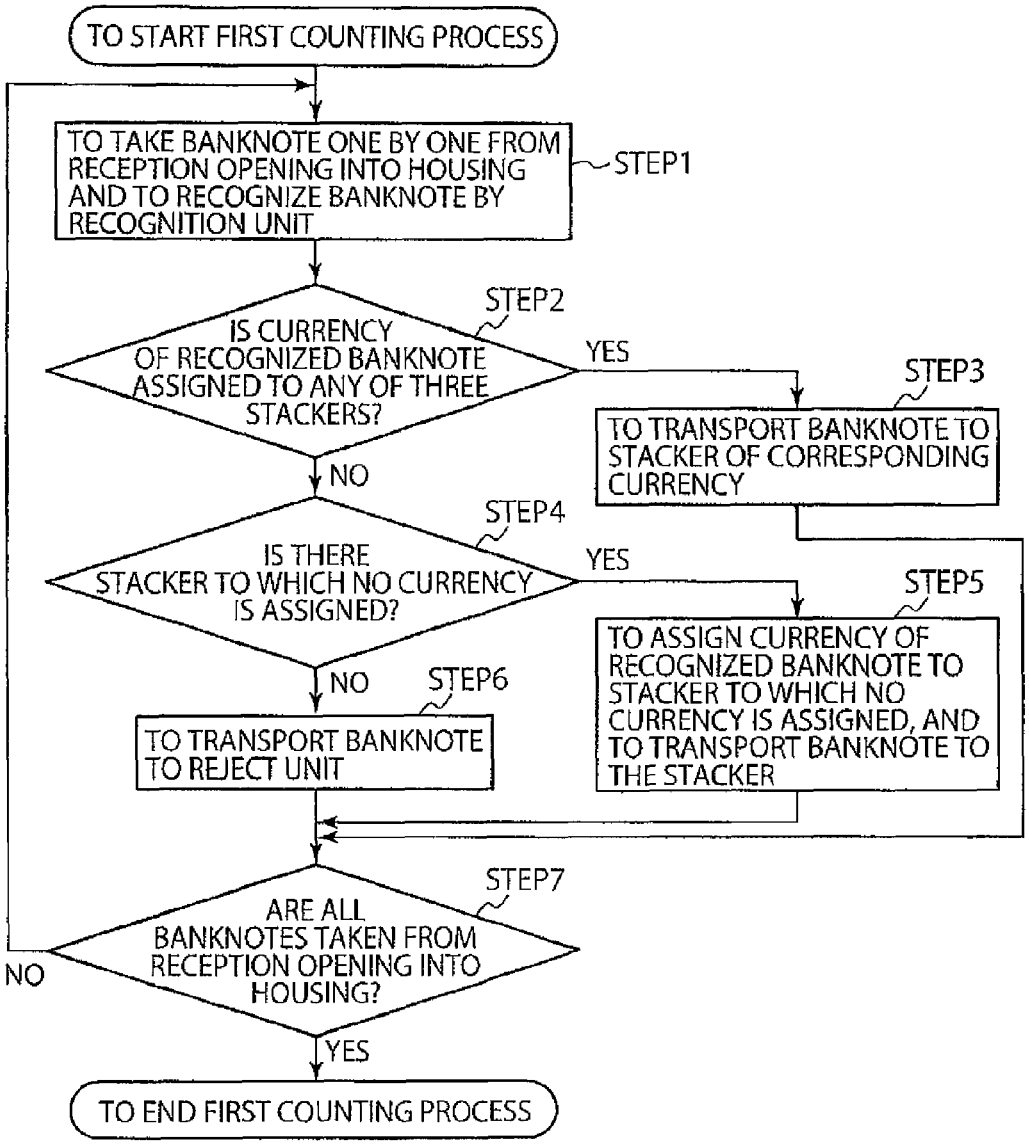
FIG. 6 is a flowchart showing a first banknote counting process in the first operation aspect of the banknote handling apparatus.

In the banknote handling apparatus 10 in this embodiment, in the first counting process, the control unit 40 is configured to judge whether a currency of the banknote having been recognized by the recognition unit 32 is assigned to any of the stackers 23, 24 and 25 (STEP 2 of FIG. 6). When the currency of the banknote having been recognized by the recognition unit 32 is assigned to any of the stackers 23, 24 and 25 ("YES" in STEP 2 of FIG. 6), the banknote is transported to the stacker (STEP 3 of FIG. 6). On the other hand, when the currency of the banknote having been recognized by the recognition unit 32 is not assigned to any of the stackers 23, 24 and 25 ("NO" in STEP 2 of FIG. 6), the control unit 40 judges whether there is a stacker to which no currency is assigned (STEP 4 of FIG. 6). When there is a stacker to which no currency is assigned ("YES" in STEP 4 of FIG. 6), the currency of the banknote having been recognized by the recognition unit 32 is assigned to the stacker, and the banknote is transported to the assigned stacker (STEP 5 of FIG. 6). On the other hand, when there is no stacker to which no currency is assigned ("NO" in STEP 4 of FIG. 6), the banknote having been recognized by the recognition unit 32 is transported to the reject unit 22 (STEP 6 of FIG. 6).

When a banknote recognized by the recognition unit 32 is not a normal banknote such as a counterfeit banknote, when a banknote could not be recognized by the recognition unit 32, and when a banknote is detected as an erroneously transported banknote, such a banknote is transported as a reject banknote to the reject unit 22.

The aforementioned operations shown in the STEP 1 to STEP 6 of FIG. 6 are performed until all the banknotes are taken into the housing 11 from the inlet 21 ("NO" in STEP 7 of FIG. 6). After all the banknotes have been taken into the housing 11 from the inlet 21 ("YES" in STEP 7 of FIG. 6), the first counting process is ended.

Next, as to the first banknote counting process shown in the flowchart of FIG. 6, there is described a concrete example in which a plurality of batches of banknotes of different currencies as shown in FIG. 4 are simultaneously placed in the inlet 21 of the banknote handling apparatus 10.

When the plurality of batches of banknotes as shown in FIG. 4 are simultaneously placed in the inlet 21 of the banknote handling apparatus 10, the US dollar banknotes are firstly taken into the housing 11. The first US dollar banknote is recognized by the recognition unit 32. At this time, since no currency is assigned to the stackers 23, 24 and 25 ("NO" in STEP 2 of FIG. 6 and "YES" in STEP 4 of FIG. 6) in the default state, US dollar is assigned as a currency to, e.g., the first stacker 23 out of the three stackers. Thus, the first US dollar banknote is transported to the first stacker 23. Thereafter, the second US dollar banknote and the US banknotes succeeding thereto are taken into the housing 11 and recognized by the recognition unit 32. Since US dollar is assigned as a currency to the first stacker 23 ("YES" in STEP 2 of FIG. 6), all the US dollar banknotes are transported to the first stacker 23. In this manner, the US dollar banknotes are stacked in the denomination mixed state in the first stacker 23 (see FIG. 5).

Then, following to the US dollar banknotes, the Euro banknotes are taken into the housing 11. The first Euro banknote is recognized by the recognition unit 32. At this time, since US dollar is assigned as a currency to the first stacker 23 and no currency is assigned to the other stackers 24 and 25 ("NO" in STEP 2 of FIG. 6 and "YES" in STEP 4 of FIG. 6), Euro is assigned as a currency to, e.g., the second stacker 24 out of the two stackers to which no currency was assigned. Thus, the first Euro banknote is transported to the second stacker 24. Thereafter, when the second Euro banknote and the Euro banknotes succeeding thereto are taken into the housing 11 and recognized by the recognition unit 32, since Euro is assigned as a currency to the second stacker 24 ("YES" in STEP 2 of FIG. 6), all the Euro banknotes are transported to the second stacker 24. In this manner, the Euro banknotes are stacked in the denomination mixed state in the second stacker 24 (see FIG. 5).

Then, following to the Euro banknotes, the Turkish lira banknotes are taken into the housing 11. The first Turkish lira banknote is recognized by the recognition unit 32. At this time, since US dollar and Euro are assigned as currencies to the first and second stackers 23 and 24 and no currency is assigned to the third stacker 25 ("NO" in STEP 2 of FIG. 6 and "YES" in STEP 4 of FIG. 6), Turkish lira is assigned as a currency to the third stacker 25 to which no currency was assigned. Thus, the first Turkish lira banknote is transported to the third stacker 25. Thereafter, when the second Turkish lira banknote and the Turkish lira banknotes succeeding thereto are taken into the housing 11 and recognized by the recognition unit 32, since Turkish lira is assigned as a currency to the third stacker 25 ("YES" in STEP 2 of FIG. 6), all the Turkish lira banknotes are transported to the third stacker 25. In this manner, the Turkish lira banknotes are stacked in the denomination mixed state in the third stacker 25 (see FIG. 5).

After US dollar, Euro and Turkish lira have been assigned as currencies to the three stackers 23, 24 and 25, when a currency of a banknote having been recognized by the recognition unit 32 is other than the above US dollar, Euro and Turkish lira (specifically, for example, when a currency of the banknote is Japanese yen), the banknote is transported to the reject unit 22 (see FIG. 5).

After the first banknote counting process as shown in the flowchart of FIG. 6 has been ended, the display units 43, 44 and 45 respectively corresponding to the stackers 23, 24 and 25 display currencies of banknotes stacked in the corresponding stackers. Specifically, the first display unit 43 displays "US dollar", the second display unit 44 displays "Euro" and the third display unit 45 displays "Turkish lira". Instead of displaying the currencies on the respective display units 43, 44 and 45 after the first banknote counting process has been ended, the respective display units 43, 44 and 45 may display the currencies when the currencies of banknotes are assigned to the respective stackers 23, 24 and 25, which is shown in STEP 5 of FIG. 6. In addition, the information as to which currency is assigned to each of the stackers 23, 24 and 25 may be displayed on the monitor of the operation display unit 41, in place of the display units 43, 44 and 45.

After the first banknote counting process has been ended, a confirmation command is given to the control unit 40 by an operator through the operation display unit 41, so that a deposit amount of banknotes is confirmed for each currency. Specifically, the monitor of the operation display unit 41 selectively displays, in an alternate manner, a total amount of US dollar banknotes, a total amount of Euro banknotes and a total amount of Turkish lira banknotes stacked in the respective stackers 23, 24 and 25. That is to say, a total amount of US dollar banknotes stacked in the first stacker 23 is firstly displayed on the monitor of the operation display unit 41. Then, when an operator pushes down a switch key of the operation display unit 41, a total amount of Euro banknotes stacked in the second stacker 24 is displayed. Then, when the operator further pushes down the switch key of the operation display unit 41, a total amount of Turkish lira banknotes stacked in the third stacker 25 is displayed. Then, when the operator further pushes down the switch key of the operation display unit 41, the display on the monitor of the operation display unit 41 returns to the total amount of US dollar banknotes stacked in the first stacker 23. While a total amount of banknotes of each currency is displayed on the monitor of the operation display unit 41, if the operator pushes down a confirmation key of the operation display unit 41, the displayed total amount of banknotes of the currency is confirmed.

When a total amount of banknotes of each currency is displayed on the operation display unit 41, the total amount of banknotes of each currency may be displayed in a manner converted to a specific currency (e.g., US dollar). In this case, for example, a total amount of Euro banknotes and a total amount of Turkish lira are respectively displayed on the operation display unit 41 in a manner converted to US dollar.

Instead of selectively displaying, in an alternate manner, the total amount of US dollar banknotes, the total amount of Euro banknotes and the total amount of Turkish lira banknotes on the operation display unit 41, the operation display unit 41 may selectively display, in an alternate manner, the number of US dollar banknotes for each denomination or an amount thereof, the number of Euro banknotes for each denomination or an amount thereof, and the number of Turkish lira banknotes for each denomination or an amount thereof.

In the banknote handling apparatus 10 in this embodiment, when a reject banknote is detected by the recognition unit 32 in the aforementioned first counting process, an operator may manually input a currency of the reject banknote and a denomination thereof to the control unit 40 through the operation display unit 41. In addition, when a currency of the reject banknote has been judged by the recognition unit 32 upon detection of the reject banknote by the recognition unit 32, the control unit 40 may be configured to suspend the banknote handling process performed by the banknote handling apparatus 10, and to cause the monitor of the operation display unit 41 to display information about the reject banknote. In this case, when an operator manually inputs the reject banknote information to the control unit 40 through the operation display unit 41, the operator can input the reject banknote information while visually confirming the reject banknote information displayed on the monitor of the operation display unit 41, specifically, a currency or the like of the reject banknote, for example.

After the above-described first banknote counting process has been ended, the banknotes sorted by currency and delivered to the respective stackers 23, 24 and 25 are respectively subjected to a second banknote counting process. Specifically, the batches of banknotes are respectively taken out from the stackers 23, 24 and 25, and the taken-out batches of banknotes of three currencies are respectively subjected to the second banknote counting process. In the second banknote counting process, the banknotes of each currency are sorted by denomination and stacked in the respective stackers 23, 24 and 25. In a default state of the second banknote counting process, no denomination is assigned to the stackers 23, 24 and 25. In other words, settings of the respective stackers 23, 24 and 25 are "Denomination AUTO" (see "Second counting process" of FIG. 5).

The second banknote counting process is concretely described with reference to the flowchart shown in FIG. 7. At first, the batch of banknotes taken out from the first stacker 23 are placed in the inlet 21 of the banknote handling apparatus 10. The batch of banknotes taken out from the first stacker 23 are the US dollar banknotes which are stacked in a denomination mixed state. The banknotes placed in the inlet 21 are taken, one by one, into the housing 11 by the feeding mechanism 21. Each banknote having been taken into the housing 11 is recognized by the recognition unit 32 (STEP 11 of FIG. 7). In the second banknote counting process, the recognition unit 32 may be configured not to authenticate banknotes. This is because, since the authenticity judgment of banknotes has been already performed in the first banknote counting process, there is no possibility that a counterfeit banknote is transported to the stackers 23, 24 and 25 even when the authenticity judgment of banknotes is not performed in the second banknote counting process.

Figure 7:
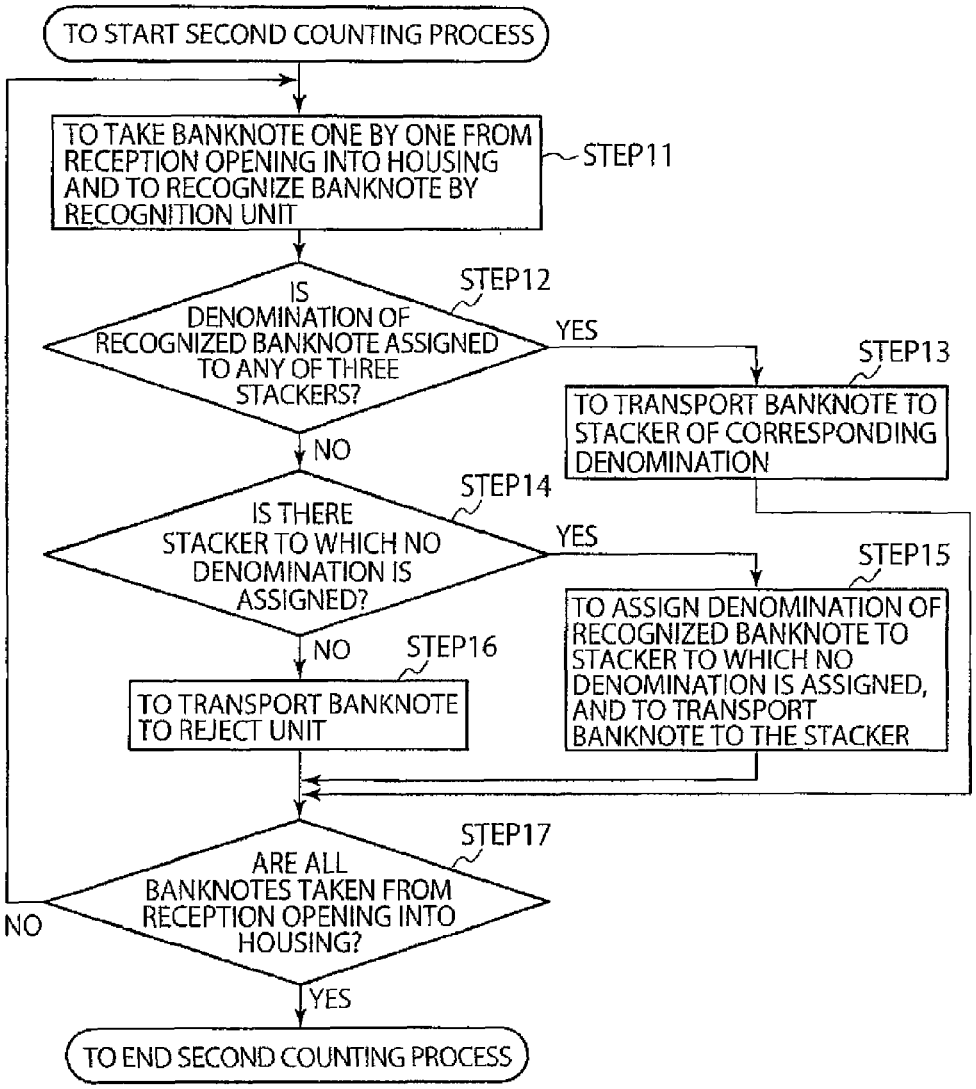
FIG. 7 is a flowchart showing a second banknote counting process in the first operation aspect of the banknote handling apparatus.

In the banknote handling apparatus 10 in this embodiment, in the second counting process, the control unit 40 is configured to judge whether a denomination of a banknote having been recognized by the recognition unit 32 is assigned to any of the three stackers 23, 24 and 25 (STEP 12 of FIG. 7). Then, when the denomination of the banknote having been recognized by the recognition unit 32 is assigned to any of the three stackers 23, 24 and 25 ("YES" in STEP 12 of FIG. 7), the banknote is transported to the stacker (STEP 13 of FIG. 7). On the other hand, when the denomination of the banknote having been recognized by the recognition unit 32 is not assigned to any of the three stackers 23, 24 and 25 ("NO" in STEP 12 of FIG. 7), the control unit 40 judges whether there is a stacker to which no denomination is assigned (STEP 14 of FIG. 7). When there is a stacker to which no denomination is assigned ("YES" in STEP 14 of FIG. 7), the denomination of the banknote having been recognized by the recognition unit 32 is assigned to the stacker, and the banknote is transported to the assigned stacker (STEP 15 of FIG. 7). Even when the denomination of the banknote having been recognized by the recognition unit 32 is assigned to any of the three stackers 23, 24 and 25, there is a case in which the stacker to which the denomination is assigned is full. In this case, if there is another stacker to which no denomination is assigned, the denomination of the banknote having been recognized by the recognition unit 32 is assigned to the latter stacker, and the banknote is transported to the latter assigned stacker. On the other hand, if there is no stacker to which no denomination is assigned ("NO" in STEP 14 of FIG. 7), the banknote having been recognized by the recognition unit 32 is transported to the reject unit 22 (STEP 16 of FIG. 7).

The aforementioned operations shown in STEP 11 to STEP 16 of FIG. 7 are performed until all the banknotes are taken into the housing 11 from the inlet 21 ("NO" in STEP 17 of FIG. 7). After all the banknotes have been taken into the housing 11 from the inlet 21 ("YES" in STEP 17 of FIG. 7), the second counting process is ended. The aforementioned second banknote counting process is performed on the banknotes for each currency. Namely, the US dollar banknotes, the Euro banknotes, and the Turkish lira banknotes are respectively subjected to the second banknote counting process as shown in the flowchart of FIG. 7.

Next, as to the above second banknote counting process, there is described a concrete example in which the batch of US dollar banknotes taken out from the first stacker 23 is placed in the inlet 21 of the banknote handling apparatus 10.

When the batch of US dollar banknotes taken out from the first stacker 23 has been placed in the inlet 21 of the banknote handling apparatus 10, the US dollar banknotes are taken, one by one, into the housing 11. The first US dollar banknote is recognized by the recognition unit 32 to find out that a denomination of the banknote is 100 dollar, for example. At this time, since no demonization is assigned to the stackers 23, 24 and 25 in the default state ("NO" in STEP 12 of FIG. 7 and "YES" in STEP 14 of FIG. 7), 100 dollar is assigned as a denomination to, e.g., the first stacker 23 out of the three stackers. Then, the 100-dollar banknote is transported to the first stacker 23. Thereafter, when a second, a third 100-dollar banknotes are taken into the housing 11 and recognized by the recognition unit 32, all the 100-dollar banknotes are transported to the first stacker 23 because 100 dollar is assigned as a denomination to the first stacker 23 ("YES" in STEP 12 of FIG. 7).

On the other hand, when a US dollar banknote of a denomination other than 100 dollar, specifically, a 20-dollar banknote, for example, is taken into the housing 11 and recognized by the recognition unit 32, since 100 dollar is assigned as a denomination to the first stacker 23 and no denomination is assigned to the other stackers 24 and 25, 20 dollar is assigned as a denomination to, e.g., the second stacker 24 out of the two stackers to which no denomination was assigned. Thus, the 20-dollar banknote is transported to the second stacker 24. Thereafter, when a second, a third . . . 20 dollar banknotes are taken into the housing 11 and recognized by the recognition unit 32, all the 20-dollar banknotes are transported to the second stacker 24 because 20 dollar is assigned as a denomination to the second stacker 24 ("YES" in STEP 12 of FIG. 7).

After 20 dollar has been assigned as a denomination to the second stacker 24, when a US dollar banknote of a denomination other than 100 dollar and 20 dollar, specifically, a 10-dollar banknote, for example, is taken into the housing 11 and recognized by the recognition unit 32, since 100 dollar and 20 dollar are respectively assigned as denominations to the first and second stackers 23 and 24 and no denomination is assigned to the third stacker 25 ("NO" in STEP 12 of a FIG. 7 and "YES" in STEP 14 of FIG. 7), 10 dollar is assigned as a denomination to the third stacker 25 to which no denomination was assigned. Thus, the 10-dollar banknote is transported to the third stacker 25. Thereafter, when a second, a third . . . 10 dollar banknotes are taken into the housing 11 and recognized by the recognition unit 32, all the 10-dollar banknotes are transported to the third stacker 25 because 10 dollar is assigned as a denomination to the third stacker 25 ("YES" in STEP 12 of FIG. 7).

In the second banknote counting process, when a banknote recognized by the recognition unit 32 is detected as an erroneously transported banknote, the banknote is transported as a reject banknote to the reject unit 22. In addition, after 100 dollar, 20 dollar and 10 dollar have been respectively assigned as denominations to the three stackers 23, 24 and 25, when a denomination of a banknote having been recognized by the recognition unit 32 is other than the above 100 dollar, 20 dollar and 10 dollar (specifically, when a denomination is 5 dollar, for example), the banknote is transported to the reject unit (see FIG. 5).

After the second banknote counting process as shown in the flowchart of FIG. 7 has been ended, the display units 43, 44 and 45 respectively corresponding to the stackers 23, 24 and 25 display denominations of banknotes stacked in the corresponding stackers. Specifically, the first display unit 43 displays "100 dollar", the second display unit 44 displays "20 dollar" and the third display unit 45 displays "10 dollar". Instead of displaying the denominations on the respective display units 43, 44 and 45 after the second banknote counting process has been ended, the respective display units 43, 44 and 45 may display the denominations when the denominations of banknotes are assigned to the respective stackers 23, 24 and 25, which is shown by STEP 15 of FIG. 7.

After the second banknote counting process for the US dollar banknotes has been ended, the monitor of the operation display unit 41 displays the number of US dollar banknotes stacked in each of the respective stackers 23, 24 and 25 for each denomination, a total amount thereof, and/or a total amount of the US dollar banknotes of all the denominations. Then, when an operator pushes down the confirmation key of the operation display unit 41, a deposit amount of the US dollar banknotes is confirmed.

After the second counting process for the US dollar banknotes has been ended, the Euro banknotes and the Turkish lira banknotes are subjected to the second counting process, similarly to the second counting process for the US dollar banknotes. After the US dollar banknotes, the Euro banknotes and the Turkish lira banknotes have been subjected to the second counting process, the operation of the banknote handling apparatus 10 in this embodiment is completed.

In the first and second banknote counting processes as shown in FIGS. 6 and 7, when a banknote count result by the second counting process matches to a banknote count result by the first counting process, the control unit 40 may be configured to automatically confirm a deposit amount of banknotes, without an operator manually confirming a deposit amount of banknotes through the operation display unit 41. In this case, after the second banknote counting process has been ended, a step in which a deposit amount is manually confirmed by an operator can be omitted.

As described above, according to the banknote handling apparatus 10 in this embodiment, banknotes are handled as follows. In the first banknote counting process, it is judged whether a currency of a banknote having been recognized by the recognition unit 32 is assigned to any of the plurality of stackers (outlets) 23, 24 and 25 (STEP 2 of FIG. 6). When the currency of the banknote having been recognized by the recognition unit 32 is assigned to any of the stackers 23, 24 and 25, the banknote is transported to the stacker (STEP 3 of FIG. 6). On the other hand, when the currency of the banknote having been recognized by the recognition unit 32 is not assigned to any of the stackers 23, 24 and 25, if there is a stacker to which no currency is assigned ("YES" in STEP 4 of FIG. 6), the currency is assigned to the stacker, and the banknote is transported to the assigned stacker (STEP 5 of FIG. 6). According to such a banknote handling apparatus 10, when banknotes issued by various issuing countries are placed in a mixed state in the inlet 21, a banknote sorting operation can be efficiently performed.

In addition, in the banknote handling apparatus 10 in this embodiment, when the banknotes sorted and delivered to the respective stackers 23, 24 and 25 are subjected to the second counting process, as shown in FIG. 5, the banknotes of each currency are sorted by denomination and delivered to the respective stackers 23, 24 and 25.

The banknote handling apparatus 10 in this embodiment is not limited to the aforementioned manner, and can be variously modified.

For example, the second banknote counting process is not limited to the operation shown in the flowchart of FIG. 7. As an alternative example, when the second banknote counting process is performed, the control unit 40 may be configured to automatically assign, to the respective stackers 23, 24 and 25, for each currency, denominations in descending order of the number of banknotes of each denomination in a banknote count result by the first counting process by means of the recognition unit 32. Specifically, for example, the number of stacked banknotes may decrease in the order of 5-dollar banknotes, 10-dollar banknotes, 20-dollar banknotes and 100-dollar banknotes, in the US dollar banknotes stacked in the first stacker 23 after the first banknote counting process has been performed. In this case, when the second banknote counting process is performed, the control unit 40 may be configured to automatically assign beforehand 5 dollar as a banknote denomination to the first stacker 23, 10 dollar as a banknote denomination to the second stacker 24, and 20 dollar as a banknote denomination to the third stacker 25.

Alternatively, in the first banknote counting process, the control unit 40 may be configured to assign a currency of a banknote having been firstly recognized by the recognition unit 32 to a plurality of stackers. Specifically, for example, in the first banknote counting process, when a currency of a banknote having been firstly recognized by the recognition unit 32 is US dollar, the control unit 40 may be configured to assign US dollar as a common currency to the first stacker 23 and the second stacker 24. In this case, when a Euro banknote is then recognized by the recognition unit 32, Euro is assigned as a currency to the third stacker 25. Thereafter, when a Turkish lira banknote is recognized by the recognition unit 32, the Turkish lira banknote is transported to the reject unit 22. When a ratio of banknotes issued by a specific issuing country (specifically, US dollar banknotes, for example) is large relative to the amount of banknotes to be handled by the banknote handling apparatus 10, such a banknote counting process allows for a more efficient banknote sorting process by increasing the number of stackers corresponding to these banknotes.

In the aforementioned first operation aspect of the banknote handling apparatus 10, when the first banknote counting process is performed, no currency is assigned to any of the stackers 23, 24 and 25 in the default state. However, in another operation aspect of the banknote handling apparatus 10, when the first banknote counting process is performed, a specific currency may be assigned beforehand to at least any one of the stackers.

In a second operation aspect of the banknote handling apparatus 10 as described below, a beforehand specified currency is assigned beforehand to a predetermined stacker. Specifically, as shown in FIG. 8, US dollar, for example, is assigned beforehand as a common currency to the first and second stackers 23 and 24. In other words, settings of the first and second stackers 23 and 24 are "US dollar•denomination AUTO". On the other hand, no currency is assigned to the third stacker 25. In other words, a setting of the third stacker 25 is "Currency AUTO".

Then, the plurality of batches of banknotes as shown in FIG. 4 are subjected to the first counting process. Specifically, the plurality of batches of banknotes as shown in FIG. 4 are simultaneously placed in the inlet 21 of the banknote handling apparatus 10. The banknotes placed in the inlet 21 are taken, one by one, into the housing 11 by the feeding mechanism 21*a*. Each banknote having been taken into the housing 11 is recognized by the recognition unit 32 (STEP 21 of FIG. 9).

Figure 9:
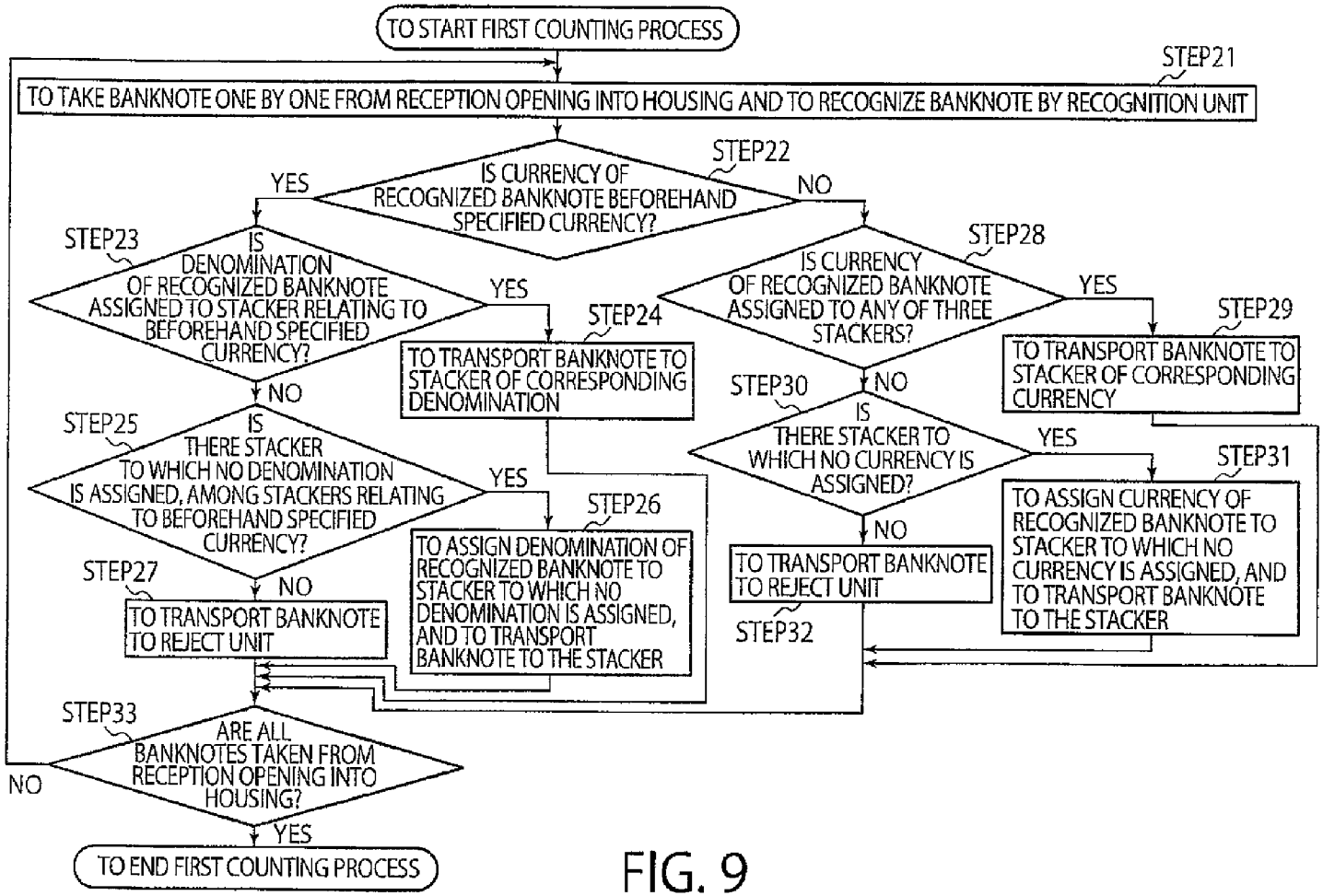
FIG. 9 is a flowchart showing a first banknote counting process in the second operation aspect of the banknote handling apparatus.

In the banknote handling apparatus 10 in this embodiment, in the first counting process, the control unit 40 judges whether a currency of the banknote having been recognized by the recognition unit 32 is the beforehand specified currency (US dollar) (STEP 22 of FIG. 9). When the currency of the banknote having been recognized by the recognition unit 32 is the beforehand specified currency (US dollar) ("YES" in STEP 22 of FIG. 9), the control unit 40 judges whether a denomination of the recognized banknote is assigned to any of the stackers relating to the beforehand specified currency (specifically, any of the first and second stackers 23 and 24) (STEP 23 of FIG. 9). When the denomination of the banknote having been recognized by the recognition unit 32 is assigned to any of the stackers relating to the beforehand specified currency ("YES" in STEP 23 of FIG. 9), the banknote is transported to the stacker (STEP 24 of FIG. 9). On the other hand, when the denomination of the banknote having been recognized by the recognition unit 32 is not assigned to any of the stackers relating to the beforehand specified currency ("NO" in STEP 23 of FIG. 9), the control unit 40 judges whether there is a stacker to which no denomination is assigned out of the stackers relating to the beforehand specified currency (STEP 25 of FIG. 9). When there is a stacker to which no denomination is assigned ("YES" in STEP 25 of FIG. 9), the denomination of the banknote having been recognized by the recognition unit 32 is assigned to the stacker, and the banknote is transported to the assigned stacker (STEP 26 of FIG. 9). On the other hand, when there is no stacker to which no denomination is assigned out of the stackers relating to the beforehand specified currency ("NO" in STEP 25 of FIG. 9), the banknote having been recognized by the recognition unit 32 is transported to the reject unit 22 (STEP 27 of FIG. 9).

When the currency of the banknote having been recognized by the recognition unit 32 is not the beforehand specified currency (US dollar) ("NO" in STEP 22 of FIG. 9), the control unit 40 judges whether the currency of the banknote having been recognized by the recognition unit 32 is assigned to any of the three stackers 23, 24 and 25 (STEP 28 of FIG. 9). When the currency of the banknote having been recognized by the recognition unit 32 is assigned to any of the three stackers 23, 24 and 25 ("YES" in STEP 28 of FIG. 9), the banknote is transported to the stacker (STEP 29 of FIG. 9). On the other hand, when the currency of the banknote having been recognized by the recognition unit 32 is not assigned to any of the three stackers 23, 24 and 25 ("NO" in STEP 28 of FIG. 9), the control unit 40 judges whether there is a stacker to which no currency is assigned (STEP 30 of FIG. 9). When there is a stacker to which no currency is assigned ("YES" in STEP 30 of FIG. 9), the currency of the banknote having been recognized by the recognition unit 32 is assigned to the stacker, and the banknote is transported to the assigned stacker (STEP 31 of FIG. 9). On the other hand, when there is no stacker to which no currency is assigned ("NO" in STEP 30 of FIG. 9), the banknote having been recognized by the recognition unit 32 is transported to the reject unit 22 (STEP 32 of FIG. 9).

When a banknote recognized by the recognition unit 32 is not a normal banknote such as a counterfeit banknote, when a banknote could not be recognized by the recognition unit 32, and when a banknote is detected as an erroneously transported banknote, such a banknote is transported as a reject banknote to the reject unit 22.

The aforementioned operations shown in the STEP 21 to STEP 32 of FIG. 9 are performed until all the banknotes are taken into the housing 11 from the inlet 21 ("NO" in STEP 33 of FIG. 9). After all the banknotes have been taken into the housing 11 from the inlet 21 ("YES" in STEP 33 of FIG. 9), the first banknote counting process is ended.

Next, as to the first banknote counting process as shown in the flowchart of FIG. 9, there is described a concrete example in which the plurality of batches of banknotes as shown in FIG. 4 are simultaneously placed in the inlet 21 of the banknote handling apparatus 10.

When the plurality of batches of banknotes as shown in FIG. 4 are simultaneously placed in the inlet 21 of the banknote handling apparatus 10, the US dollar banknotes are firstly taken into the housing 11. The first US dollar banknote is recognized by the recognition unit 32. At this time, since the currency of the banknote falls under the beforehand specified currency (i.e., banknote currency assigned beforehand to the first and second stackers 23 and 24) ("YES" in STEP 22 of FIG. 9), a denomination of the first US dollar banknote is assigned to any one of the first and second stackers 23 and 24. Specifically, when the denomination of the first US dollar banknote is 100 dollar, for example, since no denomination is assigned to any of the first and second stackers 23 and 24 in the default state, ("NO" in STEP 23 of FIG. 9 and "YES" in STEP 25 of FIG. 9), 100 dollar is assigned as a denomination to, e.g., the first stacker 23 out of the first and second stackers 23 and 24. Thus, the 100-dollar banknote is transported to the first stacker 23. Thereafter, when a second, a third . . . 100-dollar banknotes are taken into the housing 11 and recognized by the recognition unit 32, all the 100-dollar banknotes are transported to the first stacker 23 (see FIG. 8), because 100 dollar is assigned as a denomination to the first stacker 23 ("YES" in STEP 23 of FIG. 9).

On the other hand, when a US dollar banknote of a denomination other than 100 dollar, specifically, a 20-dollar banknote, for example, is taken into the housing 11 and recognized by the recognition unit 32, since 100 dollar is assigned as a denomination to the first stacker 23 and no denomination is assigned to the second stacker 24 ("NO" in STEP 23 of FIG. 9 and "YES" in STEP 25 of FIG. 9), 20 dollar is assigned as a denomination to the second stacker 24. Thus, the 20-dollar banknote is transported to the second stacker 24. Thereafter, when a second, a third . . . 20 dollar banknotes are taken into the housing 11 and recognized by the recognition unit 32, all the 20-dollar banknotes are transported to the second stacker 24 (see FIG. 8), because 20 dollar is assigned as a denomination to the second stacker 24 ("YES" in STEP 23 of FIG. 9). After 100 dollar and 20 dollar have been assigned as respective denominations to the first and second stackers 23 and 24, when a denomination of a US dollar banknote having been recognized by the recognition unit 32 is other than 100 dollar and 20 dollar (specifically, when a denomination is 10 dollar), the banknote is transported to the reject unit 22 (STEP 27 of FIG. 9).

Then, following to the US dollar banknotes, the Euro banknotes are taken into the housing 11. The first Euro banknote is recognized by the recognition unit 32. At this time, since US dollar is assigned as a currency to the first and second stackers 23 and 24 and no currency is assigned to the third stacker 25 ("NO" in STEP 28 of FIG. 9 and "YES" in STEP 30 of FIG. 9), Euro is assigned as a currency to the third stacker 25. Thus, the first Euro banknote is transported to the third stacker 25. Thereafter, when the second Euro banknote and the Euro banknotes succeeding thereto are taken into the housing 11 and recognized by the recognition unit 32, since Euro is assigned as a currency to the third stacker 25 ("YES" in STEP 28 of FIG. 9), all the Euro banknotes are transported to the third stacker 25. In this manner, the Euro banknotes are stacked in the denomination mixed state in the third stacker 25 (see FIG. 8).

Then, following to the Euro banknotes, the Turkish lira banknotes are taken into the housing 11. However, since US dollar and Euro have been already assigned as currencies to the respective stackers 23, 24 and 25, the Turkish lira banknotes are transported to the reject unit 22 (STEP 32 of FIG. 9).

When the first banknote counting process has been ended as described above, US 100-dollar banknotes are stacked in the first stacker 23, US 20-dollar banknotes are stacked in the second stacker 24, and Euro banknotes are stacked in the denomination mixed state in the third stacker 25. Meanwhile, US dollar banknotes of denominations other than 100 dollar and 20 dollar, banknotes of currencies other than US dollar and Euro (e.g., Turkish lira banknotes) as well as reject banknotes are stacked in the reject unit 22. The Euro banknotes stacked in the third stacker 25 may be subjected to the second counting process as shown in the flowchart of FIG. 7.

As described above, in the second operation aspect of the banknote handling apparatus 10, a beforehand specified currency is assigned beforehand to a predetermined stacker (specifically, US dollar is assigned beforehand to the first and second stackers 23 and 24). When a banknote of the beforehand specified currency is firstly recognized by the recognition unit 32, a denomination of the banknote is assigned to the predetermined stacker (specifically, e.g., the first stacker 23). Then, the control unit 40 judges whether both the currency and the denomination of the banknote having been recognized by the recognition unit 32 are assigned to any of the stackers 23, 24 and 25 (STEP 22 and STEP 23 of FIG. 9). When both the currency and the denomination of the banknote are assigned to any of the stackers 23, 24 and 25 ("YES" in STEP 23 of FIG. 9), the control unit 40 is configured to perform such a control that the banknote is transported to the stacker. According to such a second operation aspect of the banknote handling apparatus 10, since banknotes of a beforehand specified currency can be sorted by both currency and denomination at once in the first banknote counting process, a banknote sorting operation can be performed more efficiently.

In the above-described second operation aspect of the banknote handling apparatus 10, as shown in FIG. 8, a beforehand specified currency is assigned beforehand to a plurality of stackers (specifically, first and second stackers 23 and 24).

In addition, in the above-described second operation aspect of the banknote handling apparatus 10, when a currency of a banknote having been recognized by the recognition unit 32 is not the beforehand specified currency ("NO" in STEP 22 of FIG. 9), if there is a stacker to which no currency is assigned, the currency is assigned to the stacker, and the banknote is transported to the assigned stacker (STEP 31 of FIG. 9). On the other hand, when the currency is assigned to any stacker, the banknote is transported to the stacker (STEP 29 of FIG. 9).

In addition, in a further alternative operation aspect of the banknote handling apparatus 10, when the first banknote counting process is performed, instead of a beforehand specified currency, a beforehand specified category may be assigned beforehand to one or more predetermined stackers. The category herein means fit banknote/unfit banknote, face-up banknote/face-down banknote, orientation of a banknote and so on. Specifically, fit banknote, for example, is assigned beforehand to one stacker, while unfit banknote, for example, is assigned beforehand to another stacker. Alternatively, face-up banknote, for example, is assigned beforehand to one stacker, while face-down banknote, for example, is assigned beforehand to another stacker.

In a third operation aspect of the banknote handling apparatus 10 as described below, fit banknote/unfit banknote are assigned as beforehand specified categories to two predetermined stackers. Specifically, as shown in FIG. 10, fit banknote is assigned beforehand as a category to the first stacker 23, and unfit banknote is assigned beforehand as a category to the second stacker 24. No currency is assigned to the first and second stackers 23 and 24. In other words, settings of the first and second stackers 23 and 24 are "Currency AUTO•Fit banknote" and "Currency AUTO•Unfit banknote". On the other hand, neither currency nor category is assigned to the third stacker 25. In other words, a setting of the third stacker 25 is "Currency AUTO".

Then, the plurality of batches of banknotes as shown in FIG. 4 are subjected to the first counting process. Specifically, the plurality of batches of banknotes as shown in FIG. 4 are simultaneously placed in the inlet 21 of the banknote handling apparatus 10. The banknotes placed in the inlet 21 are taken, one by one, into the housing 11 by the feeding mechanism 21*a*. Each banknote having been taken into the housing 11 is recognized by the recognition unit 32 (STEP 41 of FIG. 11).

Figure 11:
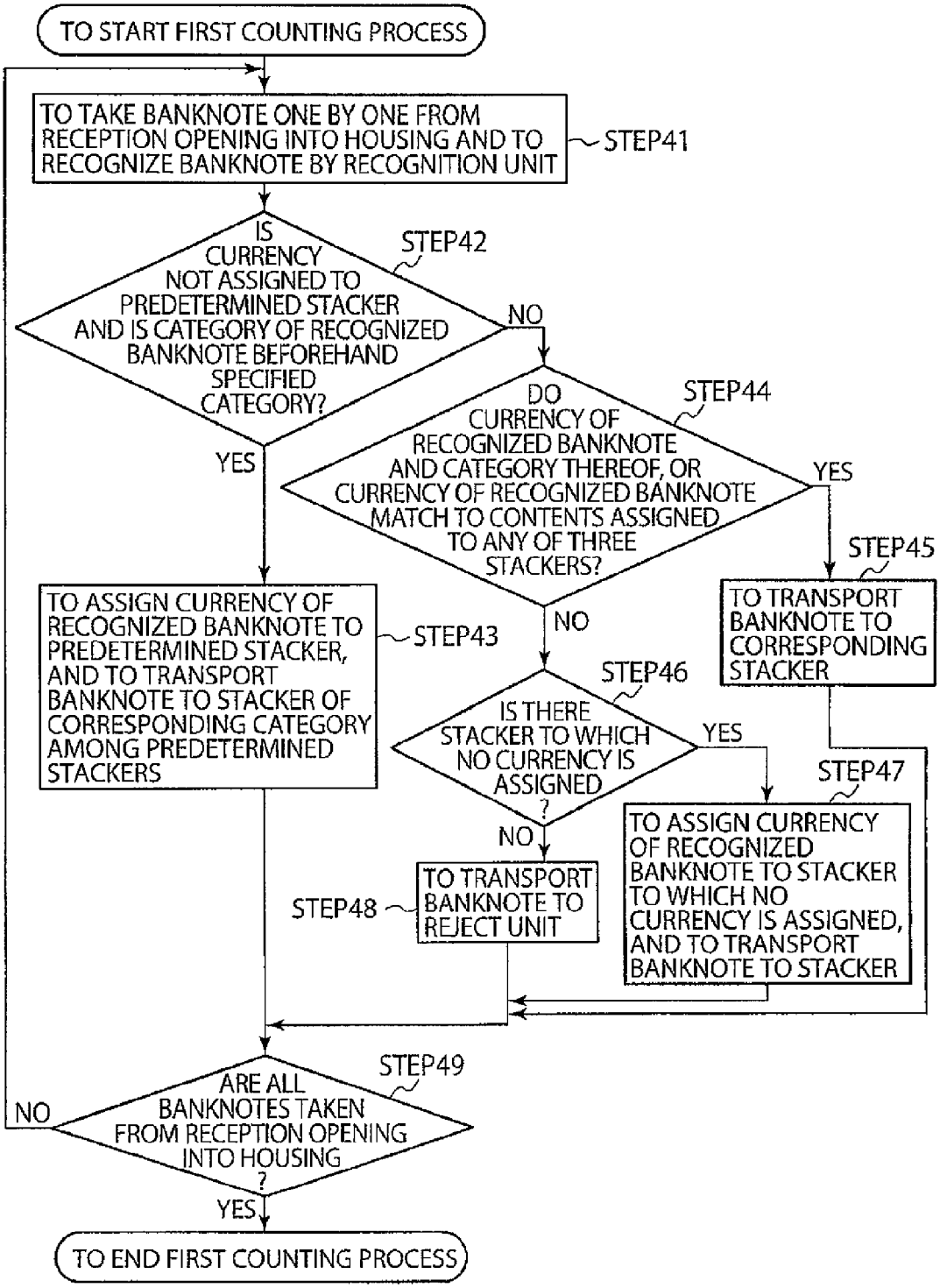
FIG. 11 is a flowchart showing a first banknote counting process in the third operation aspect of the banknote handling apparatus.

In the banknote handling apparatus 10 in this embodiment, in the first counting process, when no currency is assigned to the predetermined stackers (first and second stackers 23 and 24) and a category of a recognized banknote is the preset category (fit banknote or unfit banknote) ("YES" in SEP 42 of FIG. 11), a currency of the recognized banknote is assigned to all the predetermined stackers, and the banknote is transported to a stacker of the corresponding category out of the predetermined stackers (STEP 43 of FIG. 11). On the other hand, when a currency has been already assigned to the predetermined stackers (first and second stackers 23 and 24) or when a currency is not assigned to the predetermined stackers but a category of the recognized banknote is not the preset category ("NO" in STEP 42 of FIG. 11), the control unit 40 is configured to judge whether both the currency and the category of the banknote having been recognized by the recognition unit 32, or the currency of the banknote (when no category is assigned to the stacker) match(es) to the contents assigned to any of the three stackers 23, 24 and 25 (STEP 44 of FIG. 11). When both the currency and the category of the banknote having been recognized by the recognition unit 32 or the currency of the banknote match(es) to the contents assigned to any of the three stackers 23, 24 and 25 ("YES" in STEP 44 of FIG. 11), the banknote is transported to the stacker (STEP 45 of FIG. 11). On the other hand, when both the currency and the category of the banknote having been recognized by the recognition unit 32 or the currency of the banknote do(es) not match to the contents assigned to any of the three stackers 23, 24 and 25 ("NO" in STEP 44 of FIG. 11), the control unit 40 judges whether there is a stacker to which no currency is assigned (STEP 46 of FIG. 11). When there is a stacker to which no currency is assigned ("YES" in STEP 46 of FIG. 11), the currency of the banknote having been recognized by the recognition unit 32 is assigned to the stacker, and the banknote is transported to the assigned stacker (STEP 47 of FIG. 11). On the other hand, when there is no stacker to which no currency is assigned ("NO" in STEP 46 of FIG. 11), the banknote having been recognized by the recognition unit 32 is transported to the reject unit 22 (STEP 48 of FIG. 11).

When a banknote recognized by the recognition unit 32 is not a normal banknote such as a counterfeit banknote, when a banknote could not be recognized by the recognition unit 32, and when a banknote is detected as an erroneously transported banknote, such a banknote is transported as a reject banknote to the reject unit 22.

The aforementioned operations shown in the STEP 41 to STEP 48 of FIG. 11 are performed until all the banknotes are taken into the housing 11 from the inlet 21 ("NO" in STEP 49 of FIG. 11). After all the banknotes have been taken into the housing 11 from the inlet 21 ("YES" in STEP 49 of FIG. 11), the first counting process is ended.

Next, as to the first banknote counting process as shown in the flowchart of FIG. 11, there is described a concrete example in which the plurality of batches of banknotes as shown in FIG. 4 are simultaneously placed in the inlet 21 of the banknote handling apparatus 10.

When the plurality of batches of banknotes as shown in FIG. 4 are simultaneously placed in the inlet 21 of the banknote handling apparatus 10, the US dollar banknotes are firstly taken into the housing 11. The first US dollar banknote is recognized by the recognition unit 32 to find out that the first US dollar banknote is a fit banknote. At the time when the first US dollar banknote is recognized by the recognition unit 32, since no currency is assigned to the first and second stackers 23 and 24 as the predetermined stackers ("YES" in STEP 42 of FIG. 11), US dollar is assigned as a currency to the first and second stackers 23 and 24 (STEP 43 of FIG. 11). In addition, the first US dollar banknote having been recognized by the recognition unit 32 is transported to the first stacker 23 to which fit banknote is assigned as a category.

Thereafter, when the second US dollar banknote and US dollar banknotes succeeding thereto are recognized by the recognition unit 32, since the currency has been already assigned to the first and second stackers 23 and 24 as the predetermined stackers ("NO" in STEP 42 of FIG. 11), when a recognized US dollar banknote is a fit banknote, the banknote is transported to the first stacker 23 to which fit banknote is assigned as a category. On the other hand, when a recognized US dollar banknote is an unfit banknote, the banknote is transported to the second stacker 24 to which unfit banknote is assigned as a category (STEP 45 of FIG. 11). In this manner, US dollar fit banknotes and US dollar unfit banknotes are stacked in the denomination mixed state in the first and second stackers 23 and 24 respectively (see FIG. 10).

Then, following to the US dollar banknotes, the Euro banknotes are taken into the housing 11. The first Euro banknote is recognized by the recognition unit 32. At this time, since US dollar is assigned as a currency to the first and second stackers 23 and 24 and no currency is assigned to the third stacker 25 ("NO" in STEP 44 of FIG. 11 and "YES" in STEP 46 of FIG. 11), Euro is assigned as a currency to the third stacker 25. Thus, the first Euro banknote is transported to the third stacker 25. Thereafter, the second Euro banknote and the Euro banknotes succeeding thereto are taken into the housing 11 and recognized by the recognition unit 32. At this time, since Euro is assigned as a currency to the third stacker 25 ("YES" in STEP 44 of FIG. 11), all the Euro banknotes are transported to the third stacker 25. In this manner, the Euro banknotes are stacked in the denomination mixed state in the third stacker 25 (see FIG. 10).

Then, following to the Euro banknotes, the Turkish lira banknotes are taken into the housing 11. However, since US dollar and Euro have been already assigned as currencies to the respective stackers 23, 24 and 25, the Turkish lira banknotes are transported to the reject unit 22 (STEP 48 of FIG. 11).

When the first banknote counting process has been ended as described above, US dollar fit banknotes are stacked in the denomination mixed state in the first stacker 23, US dollar unfit banknotes are stacked in the denomination mixed state in the second stacker 24, and Euro banknotes are stacked in the denomination mixed state in the third stacker 25. Meanwhile, banknotes of currencies other than US dollar and Euro (e.g., Turkish lira banknotes) as well as reject banknotes are stacked in the reject unit 22. The Euro banknotes stacked in the third stacker 25 may be subjected to the second counting process as shown in the flowchart of FIG. 7.

As described above, in the third operation aspect of the banknote handling apparatus 10 as shown in FIGS. 10 and 11, a beforehand specified category is assigned beforehand to a predetermined stacker (specifically, fit banknote and unfit banknote are assigned beforehand as beforehand specified categories to the first and second stackers 23 and 24). When a banknote of the beforehand specified category is firstly recognized by the recognition unit 32, a currency of the banknote is assigned to the predetermined stacker (specifically, first and second stackers 23 and 24). Then, the control unit 40 judges whether both the currency and the category of the banknote having been recognized by the recognition unit 32 are assigned to any of the stackers 23, 24 and 25 (STEP 44 of FIG. 11). When both the currency and the category of the banknote are assigned ("YES" in STEP 44 of FIG. 11), the control unit 40 is configured to perform such a control that the banknote is transported to the stacker. According to the third operation aspect of the banknote handling apparatus 10, since banknotes of beforehand specified categories can be sorted by both currency and category at once in the first banknote counting process, a banknote sorting operation can be performed more efficiently.

In the aforementioned third operation aspect of the banknote handling apparatus 10, after a currency (e.g., US dollar) has been assigned to a predetermined stacker (first and second stackers 23 and 24), when a banknote of another currency (e.g., Euro banknote) is recognized by the recognition unit 32, the other currency is assigned to a stacker (third stacker 25) other than the predetermined stacker.

In the aforementioned third operation aspect of the banknote handling apparatus 10, the control unit 40 may be configured to assign a currency of a banknote having been firstly recognized by the recognition unit 32 to three or more stackers, and a beforehand specified category may be assigned to two of these stackers. Namely, when a first US dollar banknote is recognized by the recognition unit 32, US dollar may be assigned as a currency not only to the first and second stackers 23 and 24 but also to the third stacker 25. In this case, when a large number of US dollar banknotes are included in banknotes to be handled by the banknote handling apparatus 10, since the third stacker 25 can be used as a spare stacker, banknotes can be handled more efficiently.

In another operation aspect of the banknote handling apparatus 10, when the first banknote counting process is performed, a category of three or more levels of fitness relating to fit banknote/unfit banknote may be assigned beforehand to one or more predetermined stacker(s). The three or more levels of fitness relating to fit banknote/unfit banknote herein mean, for example, an ATM fit banknote (a banknote that is rather a new banknote than a general banknote and can be used in ATM), a general fit banknote and an unfit banknote. Specifically, ATM fit banknote is assigned beforehand to one stacker, for example, fit banknote is assigned beforehand to another stacker, for example, and unfit banknote is assigned beforehand to yet another stacker.

In a fourth operation aspect of the banknote handling apparatus 10 as described below, ATM fit banknote, fit banknote and unfit banknote are respectively assigned beforehand as beforehand specified categories to three predetermined stackers. Specifically, as shown in FIG. 12, ATM fit banknote is assigned beforehand as a category to the first stacker 23, fit banknote is assigned beforehand as a category to the second stacker 24, and unfit banknote is assigned beforehand as a category to the third stacker 25. Neither currency nor denomination is assigned to these stackers 23, 24 and 25. In other words, settings of the respective stackers 23, 24 and 25 are "Currency AUTO•Denomination AUTO•ATM fit banknote", "Currency AUTO•Denomination AUTO•Fit banknote", and "Currency AUTO•Denomination AUTO•Unfit banknote".

In the fourth operation aspect of the banknote handling apparatus 10, an operation similar to the operation shown in the flowchart of FIG. 11 is performed. As to the first banknote counting process in the fourth operation aspect of the banknote handling apparatus 10, a concrete example in which the plurality of batches of banknotes as shown in FIG. 4 are simultaneously placed in the inlet 21 of the banknote handling apparatus 10 is described below with reference to the flowchart of FIG. 11.

When the plurality of batches of banknotes as shown in FIG. 4 are simultaneously placed in the inlet 21 of the banknote handling apparatus 10, the US dollar banknotes are firstly taken into the housing 11. The first US dollar banknote is recognized by the recognition unit 32 to find out that the first US dollar banknote is a 100-dollar ATM fit banknote. At the time when the first US dollar banknote is recognized by the recognition unit 32, since no currency is assigned to the stackers 23, 24 and 25 as predetermined stackers ("YES" in STEP 42 of FIG. 11), US dollar is assigned as a currency to these stackers 23, 24 and 25 (STEP 43 of FIG. 11). In the fourth operation aspect of the banknote handling apparatus 10, the denomination of the first banknote having been recognized by the recognition unit 32 is also assigned to the respective stackers 23, 24 and 25. Specifically, the first denomination of 100 dollar is assigned as a denomination to the respective stackers 23, 24 and 25. The first US dollar banknote having been recognized by the recognition unit 32 is transported to the first stacker to which ATM fit banknote is assigned as a category.

Thereafter, the second US dollar banknote and the US dollar banknotes succeeding thereto are recognized by the recognition units 32. The currency has been already assigned to the respective stackers 23, 24 and 25 as the predetermined stackers ("NO" in STEP 42 of FIG. 11). Thus, when the recognized US dollar banknote is a 100-dollar ATM fit banknote, the banknote is transported to the first stacker 23 to which 100-dollar ATM fit banknote is assigned as a category, when the recognized US dollar banknote is a 100-dollar fit banknote, the banknote is transported to the second stacker 24 to which 100-dollar fit banknote is assigned as a category, or when the recognized US dollar banknote is a 100-dollar unfit banknote, the banknote is transported to the third stacker 25 to which 100-dollar unfit banknote is assigned as a category (STEP 45 of FIG. 11). In this manner, US 100-dollar banknotes as ATM fit banknotes, US 100-dollar banknotes as fit banknotes and US 100-dollar banknotes as unfit banknotes are respectively stacked in the stackers 23, 24 and 25 (see FIG. 12). Meanwhile, even in a case in which the currency of a banknote having been recognized by the recognition unit 32 is US dollar, when a denomination of the banknote is other than 100 dollar, the banknote is transported to the reject unit 22 (see FIG. 12).

Then, following to the US dollar banknotes, the Euro banknotes and the Turkish lira banknotes are taken into the housing 11. However, US dollar has been already assigned to the respective stackers 23, 24 and 25, and there is no stacker to which no currency is assigned ("NO" in STEP 44 of FIG. 11 and "NO" in STEP 46 of FIG. 11). Therefore, the Euro banknotes and the Turkish lira banknotes are transported to the reject unit 22 (STEP 48 of FIG. 11).

In this manner, when the first banknote counting process has been ended, US 100-dollar banknotes as ATM fit banknotes are stacked in the first stacker 23, US 100-dollar banknotes as fit banknotes are stacked in the second stacker 24 and US 100-dollar banknotes as unfit banknotes are stacked in the third stacker 25. Meanwhile, US dollar banknotes of a second, third, . . . denominations (specifically, US dollar banknotes of denominations other than 100 dollar), banknotes of currencies other than US dollar (e.g., Euro banknotes and Turkish lira banknotes) as well as reject banknotes are stacked in the reject unit 22.

As described above, in the fourth operation aspect of the banknote handling apparatus 10 as shown in FIG. 12, a beforehand specified category is assigned beforehand to a predetermined stacker (specifically, ATM fit banknote, fit banknote and unfit banknote are respectively assigned beforehand as beforehand specified categories to the stackers 23, 24 and 25). When a banknote of the beforehand specified category is firstly recognized by the recognition unit 32, a currency of the banknote is assigned to the predetermined stacker (specifically, respective stackers 23, 24 and 25). Then, the control unit 40 judges whether both the currency and the category of the banknote having been recognized by the recognition unit 32 are assigned to any of the stackers 23, 24 and 25 (STEP 44 of FIG. 11). When both the currency and the category of the banknote are assigned ("YES" in STEP 44 of FIG. 11), the control unit 40 is configured to perform such a control that the banknote is transported to the stacker. According to such a fourth operation aspect of the banknote handling apparatus 10, banknotes of beforehand specified categories can be sorted by both currency and category at once in the first banknote counting process. Therefore, a banknote sorting operation can be performed more efficiently. In addition, according to the fourth operation aspect of the banknote handling apparatus 10, banknotes of three or more levels of fitness relating to fit banknote/unfit banknote (specifically, ATM fit banknote, fit banknote and unfit banknote, for example) can be sorted by category.

The money handling apparatus according to the present invention is not limited to the above embodiment and can be variously modified. For example, the money handling apparatus is not limited to have three stackers and one reject unit. The number of stackers may be four or more, and the number of reject units may be two or more. In this case, due to the increased number of stackers, the number of currencies and the number of categories can be increased. In addition, in place of a banknote handling apparatus, a coin handling apparatus configured to handle coins may be used as the money handling apparatus. In this case, when coins issued by various issuing countries are placed in a mixed state in an inlet of the coin handling apparatus, a coin sorting operation can be performed efficiently with the use of the principle of the money handling apparatus of the present invention. In addition, as an alterative example, the currency may include a currency substitution medium such as a barcode ticket or a check, in addition to currencies determined by respective money issuing countries or the like.

What is claimed is:

1. A money handling apparatus comprising:

an inlet configured to receive money of a plurality of different currencies and to take the received money into an apparatus body;

a transport unit configured to transport the money having been taken into the apparatus body from the inlet;

a plurality of stackers configured to stack the money transported by the transport unit;

a recognition unit disposed on the transport unit and configured to recognize the money of different currencies; and a control unit configured to judge whether the currency of each money having been recognized by the recognition unit is assigned to any of the stackers and to control the transport unit such that: when a stacker is assigned to the currency of the money having been recognized by the recognition unit, the money is transported to the assigned stacker, and when no stacker is assigned to the currency of the money recognized by the recognition unit and there is another stacker to which no currency is assigned, the another stacker is assigned to the currency of the money recognized by the recognition unit and the money is transported to the another stacker;

a display unit configured to selectively display a total amount of money for a currency to be displayed, the total amount of money being counted based on the money recognition result by the recognition unit; and an operation unit configured to change the total amount of money for the currency to be displayed to another total amount of money for another currency to be displayed in an alternate manner, wherein each of the stackers stacks the money for assigned currency in a denomination mixed state, and the display unit displays the total amount of money obtained by counting money of each denomination.

2. The money handling apparatus according to claim 1, wherein when the total amount of money for each currency is displayed on the display unit, the control unit is configured to cause the display unit to display the total amount of money for each currency in a manner converted to a predetermined currency.

3. The money handling apparatus according to claim 1, wherein when a confirmation command is given to the control unit, the control unit is configured to confirm a deposit amount of money for each currency.

4. The money handling apparatus according to claim 3, wherein the control unit is configured to confirm a deposit amount of money for the currency being displayed on the display unit.

5. The money handling apparatus according to claim 1, wherein the control unit is configured to cause the display unit to display which stacker is assigned to each currency.

6. The money handling apparatus according to claim 1, wherein the control unit is configured to allow the operation unit to operate, when a plurality of currencies is recognized by the recognition unit.

7. The money handling apparatus according to claim 1, wherein the control unit is configured to assign a currency of money having been firstly recognized by the recognition unit to at least two or more stackers.

8. The money handling apparatus according to claim 1, wherein the control unit is configured to cause the display unit to display a total amount of money for each currency and/or the number or amount of money for each denomination.

9. The money handling apparatus according to claim 1, wherein the control unit is configured to cause the display unit to display a counted result of one currency.

10. The money handling apparatus according to claim 1, wherein the control unit is configured to cause the display unit to firstly display a counted result of a currency of money having been firstly recognized by the recognition unit, the money being not reject money.

11. The money handling apparatus according to claim 1, wherein the display unit and the operation unit are provided in common, as a touch panel.

* * * * *